US005477782A

United States Patent [19]

Nguyen

[11] Patent Number: 5,477,782

[45] Date of Patent: Dec. 26, 1995

[54] INKING DEVICE FOR PHOTOGRAVURE PRINTING APPARATUS

[75] Inventor: Lam Nguyen, Orleans, France

[73] Assignee: Komori-Chambon S.A., Orleans, France

[21] Appl. No.: 414,048

[22] Filed: Mar. 30, 1995

Related U.S. Application Data

[63] Continuation of Ser. No. 41,487, Apr. 1, 1993, abandoned.

[30] Foreign Application Priority Data

Apr. 3, 1992 [FR] France ..... 92 04113

[51] Int. Cl.[6] ..... B41F 9/10; B41F 31/04

[52] U.S. Cl. ..... 101/157

[58] Field of Search ..... 101/366, 350, 101/157, 169, 207–210, 148, 363, 365; 118/261; 15/256.5

[56] References Cited

U.S. PATENT DOCUMENTS

| | | | |
|---|---|---|---|
| 2,168,229 | 8/1939 | MacArthur | 101/181 |
| 2,931,297 | 4/1960 | Gourriet | 101/157 |
| 3,400,658 | 9/1968 | Gagliardi et al. | 101/366 |
| 3,815,499 | 6/1974 | Abler | 101/364 |
| 4,590,855 | 5/1986 | Schommer | 101/157 |
| 4,821,672 | 4/1989 | Bruno | 101/169 |
| 5,072,669 | 12/1991 | Weisbrod | 101/366 |
| 5,121,689 | 6/1992 | Fadner | 101/366 |
| 5,125,341 | 6/1992 | Vaeso | 101/366 |
| 5,168,806 | 12/1992 | Reder et al. | 101/366 |

FOREIGN PATENT DOCUMENTS

| | | |
|---|---|---|
| 0047618 | 3/1982 | European Pat. Off. . |
| 840154 | 4/1939 | France . |
| 1239121 | 7/1960 | France . |
| 7700023 | 1/1977 | Netherlands . |

*Primary Examiner*—J. Reed Fisher

*Attorney, Agent, or Firm*—McAulay Fisher Nissen Goldberg & Kiel

[57] ABSTRACT

Disclosed is an inking device for a photogravure printing apparatus, wherein the inking chamber is closed on all sides; it is filled with ink under pressure; it extends solely over the length of the engraved part of the cylinder, and it is defined, at its two longitudinal ends, by radial closure plates with curved peripheral surfaces which are applied against the smooth end part of the engraved cylinder, on either side of its useful engraved central part.

8 Claims, 3 Drawing Sheets

INKING DEVICE FOR PHOTOGRAVURE PRINTING APPARATUS

This is a continuation of application Ser. No. 08/041,487 filed Apr. 1, 1993, now abandoned.

FIELD OF THE INVENTION

The present invention relates to an inking device for a photogravure printing apparatus.

BACKGROUND OF THE INVENTION

Inking devices of photogravure printing apparatus known at the present time generally comprise a sprayer for causing ink to flow over the peripheral surface of the engraved cylinder of the apparatus, which has cavities hollowed out therein, arranged in accordance with the pattern to be printed. These cavities are located over the greater part of the length of the cylinder, the two end parts or "stubs" of the cylinder being, on the contrary, left smooth. The sprayer is constituted by an inclined plane connected to a source of ink and it allows a quantity of ink to flow, under the sole action of gravity, quantity sufficient to obtain complete filling of all the cavities of the engraved cylinder when these cavities pass beneath the sprayer. Due to the provision of this sprayer, it is necessary to place, below the engraved cylinder, a receiver tank collecting the excess ink flowing from the sprayer and in which the lower part of the engraved cylinder is immersed.

Such a known inking device presents a certain number of drawbacks. Firstly, it is necessary, whenever the format is changed, to effect two adjustments, namely a vertical adjustment of the lower ink-receiving tank and a horizontal adjustment of the sprayer to take into account the variation in the diameter of the engraved cylinder. Furthermore, as indicated hereinabove, the lower part of the engraved cylinder is immersed in the ink contained in the receiver tank and, consequently, its two end parts or "stubs", not engraved, are coated with ink which is projected due to the rotation of the engraved cylinder. This results in that the speed of rotation of this engraved cylinder, and consequently the operational speed of the apparatus, are limited in order to avoid excessive projections of ink. Finally, the lower receiver tank must be cleaned often, this constituting a fairly long and difficult operation.

U.S. Pat. No. 3 815 499 already discloses an inking device comprising a hollow ink applicator means, parallel to the engraved cylinder and adjacent thereto over the whole length of its engraved part, in the descending movement of its generatrices, the inner volume of this applicator means being connected to a source of ink and communicating with an inking chamber defined, in the horizontal direction, by the ink applicator means, and means for adjusting the thickness of the film of ink formed from the inking chamber, on the peripheral surface of the engraved cylinder.

It is an object of the present invention to provide an inking device of particularly simple design, facilitating cleaning of the ink fountain, making it possible to obtain complete filling of the cavities in the engraved cylinder and always to maintain the non-engraved end parts of the cylinder clean, and avoiding the use, below the engraved cylinder, of a receiver tank and consequently the drawbacks involved thereby.

SUMMARY OF THE INVENTION

To that end, this inking device for a photogravure printing apparatus, comprising a horizontal cylinder driven in rotation, presenting, over the greater part of its length, an engraved peripheral surface constituted by cavities arranged in accordance with the pattern to be printed and having to be filled with ink, upon each revolution, with a view to transferring this ink onto a web to be printed, this engraved central part being located between two smooth, i.e. non-engraved, end parts, this device comprising a hollow ink applicator means parallel to the engraved cylinder and adjacent thereto over the whole length of its engraved part, in the zone of the descending movement of its generatrices, the inner volume of this applicator means being connected to a source of ink and communicating with an inking chamber defined, in the horizontal and transverse direction, by the ink applicator means, and means for adjusting the thickness of the film of ink formed from the inking chamber, on the engraved part of the peripheral surface of the cylinder, is characterized in that the inking chamber is closed on all sides; it is filled with ink under pressure; it extends solely over the length of the engraved part of the cylinder, and it is defined, at its two longitudinal ends, by radial closure plates with curved peripheral surfaces which are applied against the smooth end part of the engraved cylinder, on either side of its useful engraved central part.

According to a particular embodiment of the invention, the inking chamber is defined, in its upper part, by a flexible blade fixed, over the whole length of the ink applicator means, in an inclined position with respect to the horizontal such that its free lower end is permanently applied against the peripheral surface of the engraved cylinder, under the effect of the pressure of the ink in the inking chamber.

According to a variant embodiment, a blade is removably fixed on the body of the applicator means, in the vicinity of the peripheral surface of the engraved cylinder; it is immersed in the ink contained in the inking chamber and its lower edge is located at a short distance from the bottom of the inking chamber, in order to define an elongated lower orifice, parallel to the axis of the cylinder, of short height, for adjusting the thickness of the film of ink deposited on the peripheral surface of the engraved cylinder.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
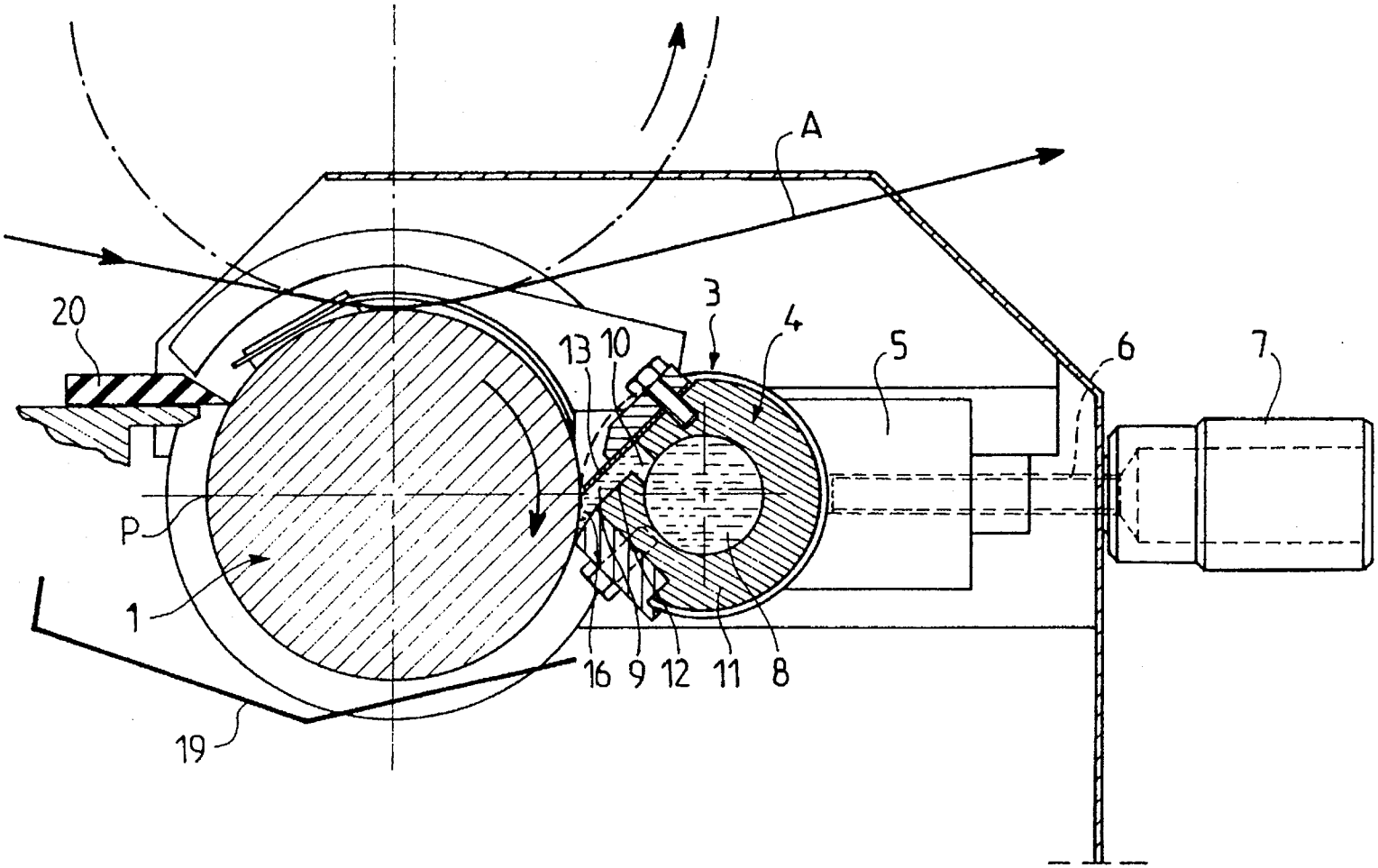
FIG. 1 is a view in partial vertical and transverse section of an inking device according to the invention for a photogravure printing apparatus.
Figure 2:
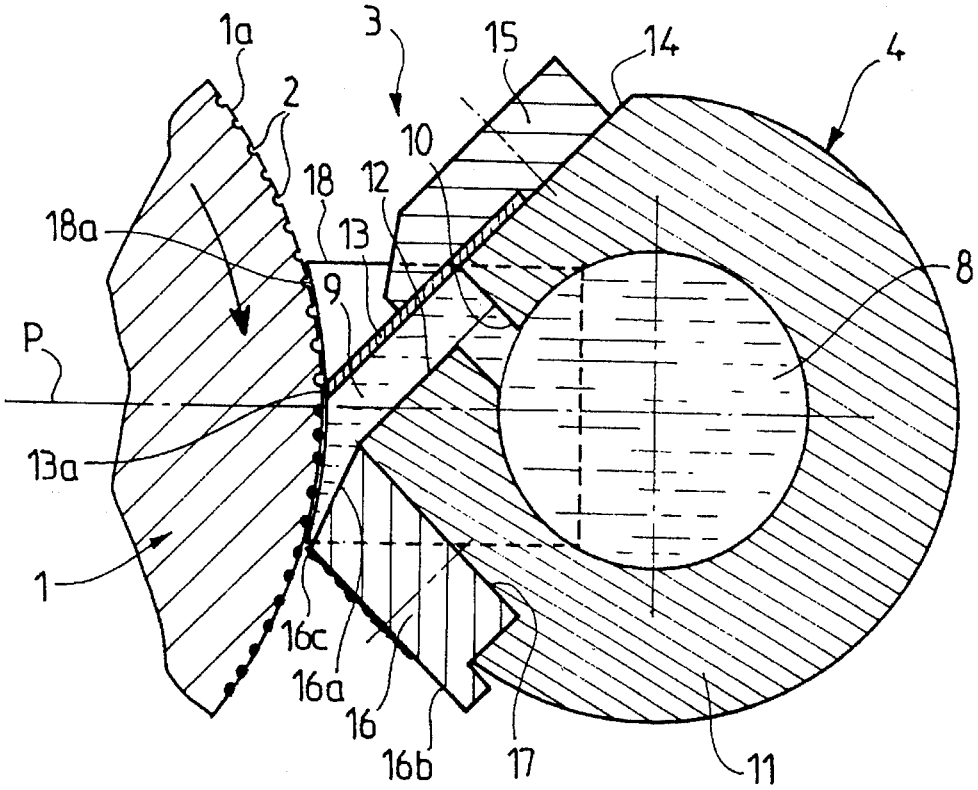
FIG. 2 is a view in vertical and transverse section, on a larger scale, of the ink applicator means and of that part of the engraved cylinder near which it is located.
Figure 3:
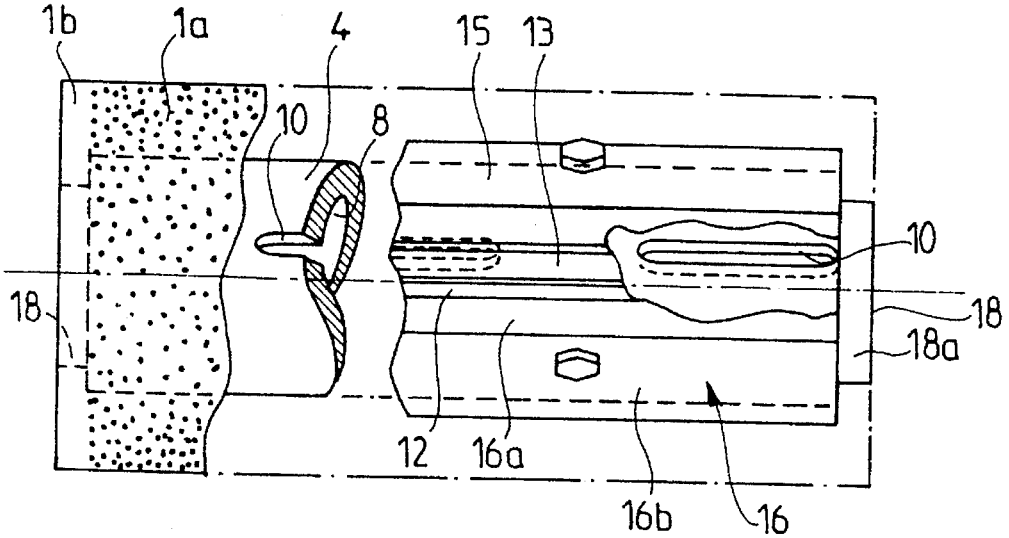
FIG. 3 is a schematic view in elevation, taken from the left of FIG. 1, the engraved cylinder being assumed to have been partially removed.
Figure 4:
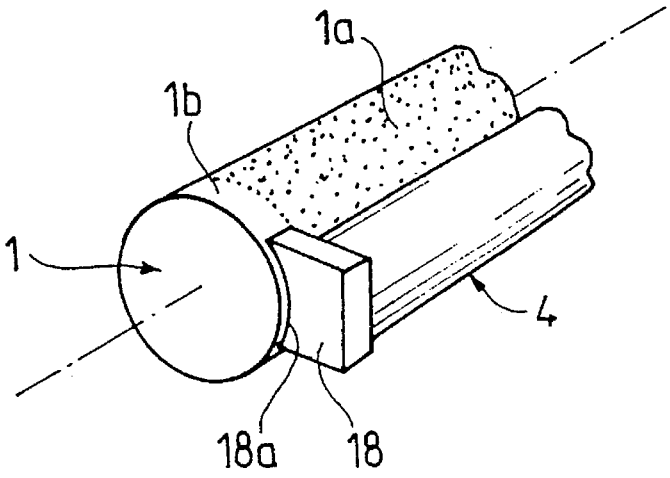
FIG. 4 is a schematic partial view in perspective of an end part of the inking device.

Referring now to the drawings, the inking device according to the invention is provided for a photogravure printing apparatus, which comprises, as shown in FIGS. 1 and 2, an engraved cylinder 1 of horizontal axis, rotating in clockwise direction. The greater part 1a *of the peripheral surface of this* cylinder 1 is engraved and presents cavities 2 distributed over this surface in accordance with the pattern to be printed on a web A advancing between the engraved cylinder 1 and an upper impression cylinder, tangential to the former, indicated in dashed and dotted lines in FIG. 1. Each of these cavities is filled with ink after passage through the inking device which is indicated as a whole by reference 3 in the drawings. Such filling of the cavities 2 with ink is effected in the zone of the descending movement of the generatrices of the engraved cylinder 1 of horizontal axis, i.e. in the right-hand part of the cylinder in FIGS. 1 and 2. According to the invention, the inking device 3 comprises a horizontal ink applicator means 4 which is mounted parallel to the engraved cylinder 1 and adjacent thereto, over the whole length of its engraved part 1a. *This ink applicator means* 4 is preferably constituted by a tube whose horizontal axis lies in the horizontal plane P passing through the axis of the engraved cylinder 1. However, this arrangement is not limiting and the axis of the ink applicator tube 4 may be located at a short distance from the horizontal plane P, being slightly offset upwardly or downwardly with respect to this horizontal plane P. The ink applicator tube 4 is mounted fixed, at its two ends, on slide blocks 5 of which each may be displaced radially and horizontally, with respect to the engraved cylinder 1, on the frame of the apparatus, by means of an adjusting screw 6 actuated by an adjusting knob 7. This makes it possible to displace the ink applicator tube 4 horizontally and parallel to itself, as a function of the format of the print, i.e. of the diameter of the engraved cylinder 1, so that the tube 4 is always located in the immediate vicinity of the engraved cylinder 1 whatever the diameter thereof.

The inner volume 8 of the tube 4 is connected to a source of ink under pressure (not shown in the drawings), which may be constituted by a pump sucking the ink from a tank and delivering it under pressure in a pipe connected to the inner volume 8 of the tube 4, at any point of this tube. The ink under pressure filling the inner volume 8 of the tube 4 is transmitted to an inking chamber 9 extending over a length shorter than that of the engraved cylinder 1. To that end, the ink passes through one or more longitudinal slots 10 formed in the upper left-hand part (i.e. located on the engraved cylinder 1 side) of the lateral wall 11 of the ink applicator tube 4 and opening in the inking chamber 9. This inking chamber 9 is defined, in the horizontal direction, on the one hand by the engraved peripheral surface 1a *of the cylinder* 1, in the zone of the descending movement of its generatrices, i.e. the right-hand part of the cylinder 1 in FIGS. 1 and 2 and, on the other hand, by the lateral wall 11 of the ink applicator tube 4. At that spot, the lateral wall 11 presents a plane longitudinal face 12 which is inclined upwardly and from left to right in FIGS. 1 and 2, i.e. from cylinder 1 towards the ink applicator tube 4. Each longitudinal slot 10 opens out in the upper part of the inclined plane face 12 and it provides communication between the inner volume 8 of the tube 4 and the inking chamber 9. This pressure-inking chamber 9 is defined, in its upper part, by a flexible longitudinal blade 13 which extends over the whole length of the tube 4, being inclined with respect to the horizontal and substantially parallel to the inclined plane face 12, above and at a distance therefrom. This upper flexible blade 13 is fixed on an upper plane face 14 of the tube 4 which extends longitudinally along the lateral wall 1 of this tube. This upper plane face 14 is formed in that part of the lateral wall 11 of the tube 4 which is located above the zone where the slots 10 are formed, and it is inclined, with respect to the horizontal, upwardly and from left to right, i.e. from the engraved cylinder 1 towards the tube 4, preferably being substantially parallel to the lower plane face 12. The upper flexible blade 13 is maintained blocked, on its upper inclined bearing face 14, by means of a block 15 immobilized by screws engaged in tapped holes provided in the lateral wall 11 of the tube 4. The free lower end **13*a* of the blade 13 forms a longitudinal edge which extends horizontally along the peripheral surface of the engraved cylinder 1 and in contact with this surface, and it is located substantially in the horizontal plane P or in the immediate vicinity thereof. In other words, the flexible blade 13 is inclined upwardly with respect to the radial plane P passing through its edge 13*a* in contact with the engraved cylinder 1. Consequently, the lower edge 13*a* of the flexible blade 13 is maintained permanently applied against the peripheral surface of the engraved cylinder 1, under the effect of the pressure of the ink present in the anchoring chamber 9, so that the flexible blade 13 performs to some extent the role of a tight flap valve avoiding at that spot any upward leakage of ink when the engraved cylinder 1 rotates clockwise at low speed, as indicated by the arrows in FIGS. 1 and 2**, or is in stopped position.

In its lower part, the inking chamber 9 is defined by a rigid lower scraper 16 which is fixed, by means of screws, on an inclined plane face 17 extending longitudinally on the lateral wall 11 of the tube 4. This inclined plane face 17 is substantially perpendicular to the plane face 12 to which it is connected and it consequently extends upwardly and from right to left in FIGS. 1 and 2, i.e. in the direction of the engraved cylinder 1. The rigid lower scraper 16 presents a plane upper face **16*a* which extends downwardly and towards the cylinder 1 the plane face 12 of the tube 4 and which is inclined more, with respect to the horizontal, than this plane face 12. Consequently, the upper face 16*a* of the scraper 16 defines, with the peripheral surface of the engraved cylinder 1, a space in the form of a wedge tapering downwardly. The inclined upper face 16*a* of the scraper 16 is connected to a plane lower face 16b, inclined in opposite direction, of the scraper 16, this inclined lower face 16*b* of the scraper 16 being substantially parallel to the plane face 17 of the lateral wall 11 of the tube 4. The inclined plane faces 16*a* and 16*b* of the scraper 16 are connected along a longitudinal horizontal edge 16*c*. This edge 16*c* is located at a short distance from the peripheral surface of the engraved cylinder 1**, which distance may be of the order of 3 to 4 tenths of a millimeter, for example.

It is seen from the foregoing description that, on leaving the inking device 3, the cavities 2 in the engraved cylinder 1 are filled with ink, as indicated in black in the lower part of cylinder 1 in FIG. 2. Between the peripheral surface of the engraved cylinder 1 and the edge **16*c* of the scraper 16 there remains a small gap making it possible to obtain hydrodynamic filling. Due to this small gap, excess ink flows along the inclined lower face 16*b* of the scraper 16 in order to be collected by an appropriate tank placed at a distance below the ink applicator tube 4**.

At each of its ends, the ink applicator tube 4 is fast with a radial closure plate 18, defining the inking chamber 9, with curved peripheral surface **18*a* of which the radius of curvature is equal to the radius of curvature of the engraved cylinder 1 having the greatest diameter, i.e. corresponding to the largest format. Each radial closure plate 18 is applied against a smooth, i.e. non-engraved, end part 1b** *of the* cylinder 1, therefore on either side of the useful engraved central part 1a, *and it is maintained in abutment on this end* part 1b *since the slide blocks* 5, bearing therebetween the ink applicator tube 4, are urged, via screws 6 and adjusting knobs 7, in the direction of the engraved cylinder 1. It is therefore seen that contact between the radial closure plates 18 of the ink applicator tube 4 and the end parts 1b *of the* engraved cylinder 1 is effected outside the engraved part 1 a, *i.e. the inked zone proper, so that the end parts* 1b *of the* cylinder 1 always remain clean and they do not project ink, which makes it possible to rotate the engraved cylinder 1 at a high speed.

An ink recovery sheet 19 is advantageously disposed below the engraved cylinder 1. This sheet 19 forms a sort of gutter, with concave or upwardly open vertical cross section; it extends parallel to the engraved cylinder 1 and its ends are free, which enables the ink collected to drop at these places. This arrangement makes it possible, with respect to the conventional gutters closed at their two ends and in which the engraved cylinder is located, to avoid blotting by the ink of the cheeks or frontal faces of the engraved cylinder and the projections of ink resulting therefrom.

As may be seen in FIG. 1, this inking device also comprises a scraper 20, extending longitudinally, which is in contact with the peripheral surface of the engraved cylinder 1, in the upper left-hand quadrant, in order to eliminate the excess ink present on the engraved peripheral surface la before the printing operation.

Figure 5:
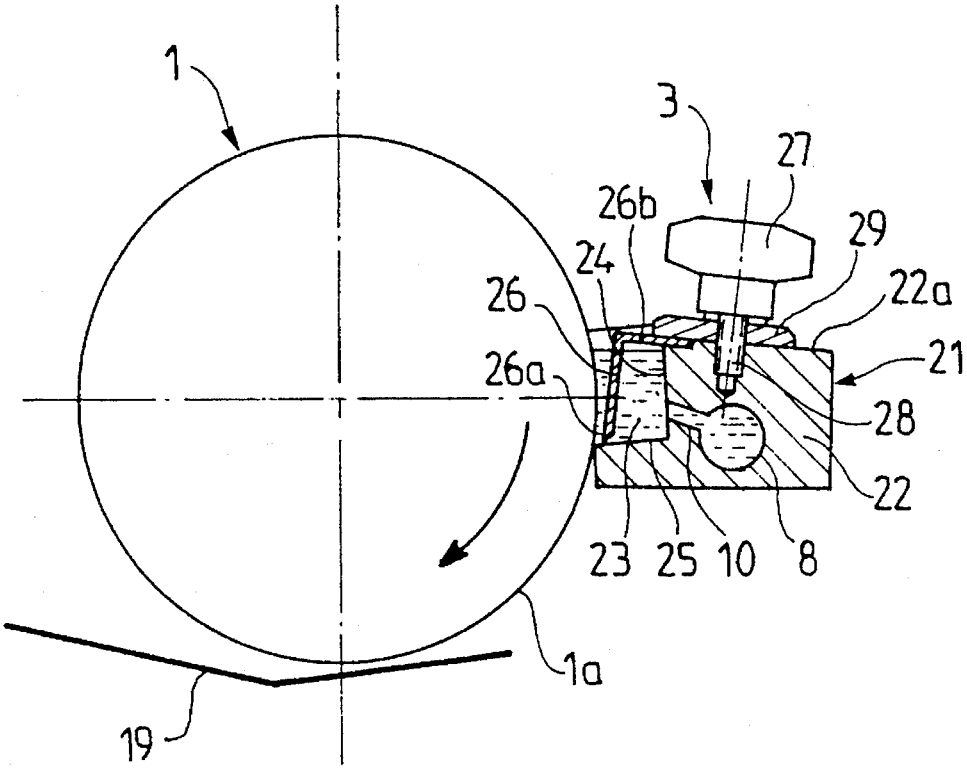
FIG. 5 is a view in vertical and transverse section of a variant embodiment of the applicator means.

In the variant embodiment shown in FIG. 5, the inking device 3 comprises an ink applicator means 21 which comprises a body 22 parallel to the engraved cylinder 1 and of substantially parallelepipedic form. This body 22 has an inking chamber 23 hollowed in its part adjacent the engraved cylinder 1, said inking chamber open towards the engraved peripheral surface 1a *of the cylinder* 1 and limited, on the other side, by a substantially vertical wall 24 of the block 22 and, in its lower part, by a bottom 25 which is horizontal or substantially inclined upwardly in the direction of the engraved cylinder 1. The inking chamber 23 is defined in its lower part by a rigid scraper terminating in a longitudinal horizontal edge 25*a* which is located at a short distance from the peripheral surface 1*a* of the engraved cylinder 2. In the inking chamber 23 is housed a substantially vertical blade 26 which is parallel to the axis of the engraved cylinder 1 and to the block 22 and of which the lower horizontal edge 26*a* is located at a short distance, for example equal to 1 millimeter, above the bottom 25 of the inking chamber 23. The blade 26 may constitute the substantially vertical arm of an angle of which the upper arm 26*b* is removably fixed on the upper surface 22*a* of the block 22. Such fixation may be effected by means of at least one blocking knob 27 extended by a threaded rod 28 screwed in a tapped hole formed in the block 22. A bearing plate 29 is interposed between each blocking knob 27 and the upper surface 22*a* of the block 22 and the upper arm 26*b* of the blade 26.

As in the case of the embodiment described hereinbefore, the ink under pressure filling the inner volume 8 of the block 22, which is connected to a source of ink under pressure, is transmitted to the inking chamber 23, passing through one or more longitudinal slots 10. This ink fills the inking chamber 23 and the blade 26 adjusts the thickness of the film of ink deposited on the peripheral surface 1a *of the engraved* cylinder 1, since its lower edge 26*a* is maintained at a short distance from the bottom 25 of the inking chamber 23. Means may be provided for adjusting as desired the height of the slot for passage of the ink defined between the lower edge 26*a* of the blade 26 and the bottom 25 of the inking chamber.

A noteworthy advantage of the inking device according to the invention is that, when the apparatus stops, everything empties automatically. In fact, as the pump for pressurizing the ink stops, the ink which is located inside the ink applicator means 4, 21 and in the inking chamber 9, 23, flows by itself, under the effect of gravity, down to the tank containing it. This allows improved cleaning of the assembly.

What is claimed is:

1. An inking device for a photogravure printing apparatus, comprising a horizontal cylinder driven in rotation, presenting, over the greater part of its length, an engraved peripheral surface constituted by cavities arranged in accordance with a pattern to be printed and having to be filled with ink, upon each revolution, with a view to transferring this ink onto a web to be printed, an engraved central part being located between two smooth, non-engraved, end parts, this device comprising:

a hollow ink applicator means parallel to an engraved cylinder and adjacent thereto over the whole length of its engraved part, in the zone of the descending movement of its generatrices;

an inner volume of this applicator means being connected to a source of ink and communicating with a closed inking chamber defined, in the horizontal and transverse directions, by the ink applicator means; and means for adjusting the thickness of the film of ink formed from the inking chamber, on the engraved part of the peripheral surface of the cylinder;

wherein the inking chamber is closed on all sides; and said closed chamber is filled with ink under pressure; it extends solely over the length of the engraved part of the cylinder, and it is defined, at its two longitudinal ends, by radial closure plates with curved peripheral surfaces which are applied against the smooth end part of the engraved cylinder, on either side of its useful engraved central part;

said inking chamber having a portion terminating in a longitudinal horizontal edge in its lower part forming a rigid lower scraper located at a short distance from the peripheral surface of said engraved cylinder; and said inking chamber being defined, in its upper part, by a blade fixed, over the whole length of the ink applicator means, in an inclined position with respect to the horizontal such that its free lower end is maintained at a short distance above the bottom of the inking chamber for defining an elongated lower orifice, parallel to the axis of the cylinder for adjusting the thickness of the film of ink deposited on the peripheral surface of the engraved cylinder.

2. The device of claim 1, wherein the ink applicator means is pierced with one or more longitudinal slots, these slots establishing communication between the inking chamber and the inner volume of the ink applicator means.

3. The device of claim 1, wherein the ink applicator means comprises a body parallel to the engraved cylinder and said inking chamber is hollowed out therein in its part adjacent to the engraved cylinder, said inking chamber being open towards the engraved peripheral surface of the cylinder, defined, in the horizontal direction, by a substantially vertical wall of a block and, in its lower part, by a bottom which is horizontal or substantially inclined in the direction of the engraved cylinder, and said blade which is parallel to the axis of the engraved cylinder and to the block.

4. The device of claim 3, wherein the blade constitutes an L-shaped angle having a substantially vertical arm and an upper arm extending from said vertical arm and being removably fixed on an upper surface of the block.

5. The device of claim 1, wherein a sheet for recovering the ink, forming a gutter open at its two ends, extends below the engraved cylinder, parallel thereto.

6. The device according to claim 1, wherein said hollow ink applicator means comprises a tube having a horizontal axis lying in a plane proximate to the axis of the engraved cylinder, said tube having said inner volume connected to said source of ink which is under pressure to provide the ink under pressure to said closed inking chamber through at least one longitudinal slot, said blade being fixed on an upper plane face of said tube, said blade having a lower edge adjacent to the peripheral surface of said engraved cylinder.

7. The device of claim 6, wherein the horizontal axis of said tube lies in a plane passing through the axis of the engraved cylinder and said closed inking chamber extends over a length shorter than that of said engraved cylinder.

8. The device of claim 6, wherein said upper plane face is formed on a part of a lateral wall of said tube formed above a zone of said at least one longitudinal slot and is substantially parallel to a lower plane face of said inking chamber.

* * * * *